United States Patent [19]

Hannah

[11] Patent Number: 4,772,881

[45] Date of Patent: Sep. 20, 1988

[54] PIXEL MAPPING APPARATUS FOR COLOR GRAPHICS DISPLAY

[75] Inventor: Marc R. Hannah, Menlo Park, Calif.

[73] Assignee: Silicon Graphics, Inc., Mountain View, Calif.

[21] Appl. No.: 923,177

[22] Filed: Oct. 27, 1986

[51] Int. Cl.[4] ..... G09G 1/28

[52] U.S. Cl. ..... 340/703; 340/701; 358/30

[58] Field of Search ..... 340/701, 702, 703, 747, 340/744; 358/30, 81

[56] References Cited

U.S. PATENT DOCUMENTS 4,484,187 11/1984 Brown et al. ..... 340/703
4,613,852 9/1986 Maruko ..... 340/703
4,684,942 8/1987 Nishi et al. ..... 340/701

FOREIGN PATENT DOCUMENTS 2167926 6/1986 United Kingdom ..... 340/703

*Primary Examiner*—Gerald L. Brigance
*Attorney, Agent, or Firm*—Blakely, Sokoloff, Taylor & Zafman

[57] ABSTRACT

An improvement for providing color information in a raster scanned video display apparatus where color data is stored in a frame buffer for each pixel in addition to color data. The color data is coupled to a crossbar switch to provide several sets of color data at the output of the switch. A multiplexer receives these several sets of color information and selects between them based on the color mode data. This permits the same color code to represent more than a single color. In a display, color in windows may then be generated from different programs, eliminating color-code dependencies between programs.

10 Claims, 1 Drawing Sheet

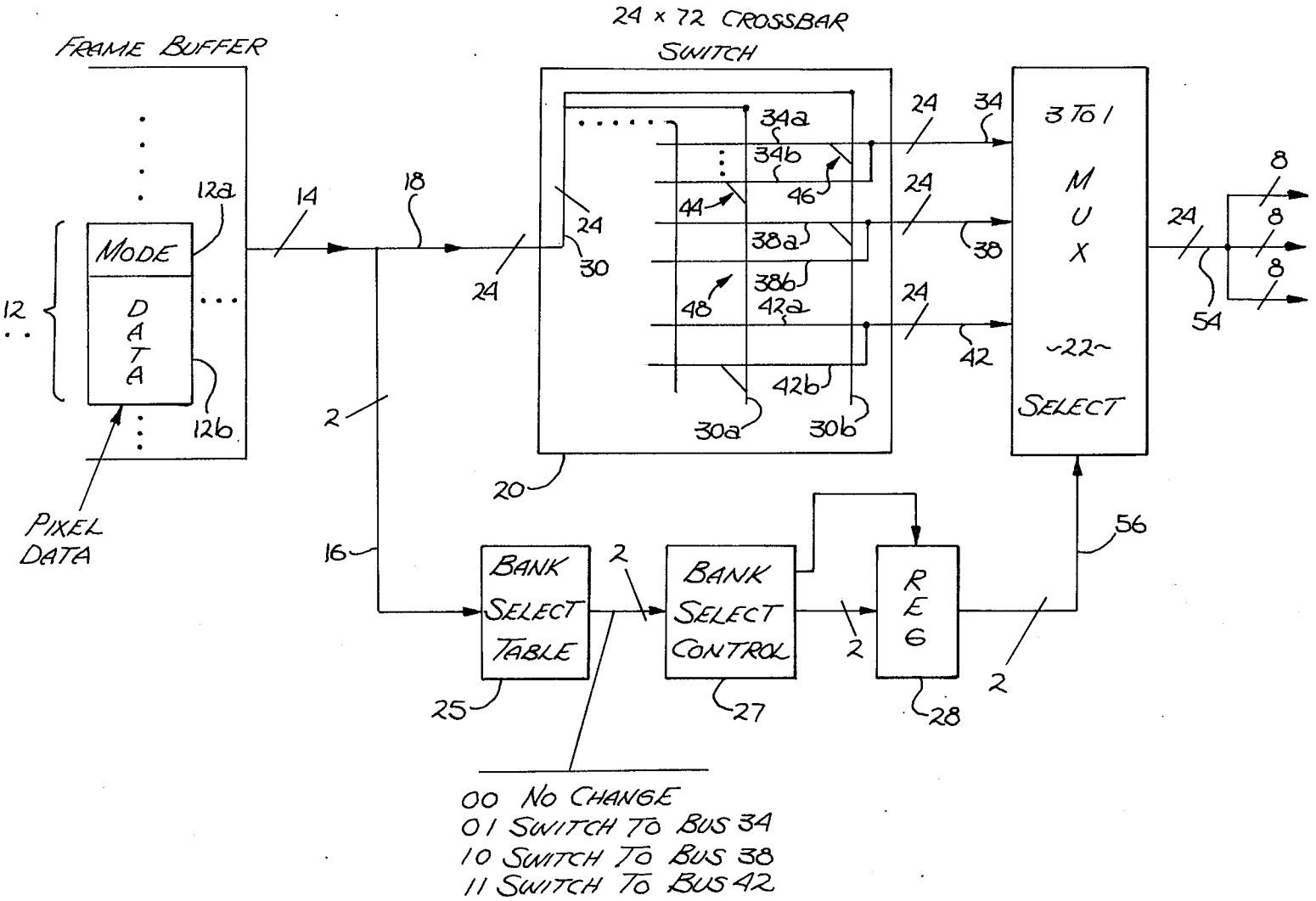
FRAME BUFFER
MODE
DATA
PIXEL DATA
24 x 72 CROSSBAR SWITCH
3 TO 1 MUX
SELECT
REG
BANK SELECT CONTROL
BANK SELECT TABLE
00 NO CHANGE
01 SWITCH TO BUS 34
10 SWITCH TO BUS 38
11 SWITCH TO BUS 42

PIXEL MAPPING APPARATUS FOR COLOR GRAPHICS DISPLAY

BACKGROUND OF THE INVENTION

1. Field of the Invention

The invention relates to the field of raster scanned color video display.

2. Prior Art

In raster scanned color video displays, color data is often stored for each pixel in a frame buffer. The color data can represent "red", "green" and "blue" (RGB) or can represent an address to a color lookup table.

In many displays a plurality of windows are simultaneously displayed with different sets of colors used in each window. It is often convenient in these displays to have a particular color code represent one color in one window, and for example, another color in the background or other windows. In other applications, it is sometimes desirable to have a particular code represent a color in some fields on the display and a shade of this color in other fields. There are other applications where it is desirable for a particular color code to represent more than a single color under certain conditions.

One method of having a color code represent more than a single color is to use additional bits of data for each pixel in the frame buffer which provide, in effect, bank switching or remapping within a color lookup table or a PROM. Assume that the color data in the frame buffer is represented by N-bits and N-bits are required to provide the RGB signals. If two additional bits are used to provide information which allows selection of different colors for a particular code then N+2 bits must be stored in the frame buffer for each pixel. A PROM for this application would have a capacity of $2^{N+2}$.N memory cells. In a typical application where N is equal to 24 bits, the amount of PROM capacity becomes very large and in practice prohibitive.

The present invention provides an apparatus which permits a single code to represent more than a single color without large memory capacity thus eliminating the undesirable interdependencies between programs running different windows. The present invention provides a softly configurable data selector to select different configurations for each pixel.

SUMMARY OF THE INVENTION

An improvement in a raster scanned video display apparatus which uses a frame buffer for storing N-bits of data representing color for each of at least a plurality of pixels used in the display is disclosed. The improvement permits the same N-bits to represent a plurality of different colors and thus is useful, for example, for windows which provide displays for different programs. Color mode information is stored in a storage means and is associated with each of the N-bits of color data. The storage means in the presently preferred embodiment is part of the frame buffer. A routing means which in the presently preferred embodiment is a crossbar switch provides routing of the N-bits of signals to provide M-bits where M is greater than N. A multiplexer means selects among sets of signals from the M-bits. This multiplexing means is controlled by a control means which receives the color mode information from the storage means. In this manner, the selection among the sets of signals at the output of the multiplexing means provides different colors.

BRIEF DESCRIPTION OF THE DRAWING

The drawing is a block diagram of the presently preferred embodiment of the invention.

DETAILED DESCRIPTION OF THE PRESENT INVENTION

An improved video color apparatus is described for a raster scanned display where signals representing color data are stored in a buffer such as a frame buffer. The improvement allows the same color data to represent a plurality of different colors in different modes. In the following description numerous specific details are set forth such as specific numbers of bits, etc., in order to provide a thorough understanding of the present invention. It will be obvious, however, to one skilled in the art that these specific details are not needed to practice the present invention. In other instances, well-known circuits are shown in block diagram form in order not to unnecessarily obscure the present invention in detail.

Referring now to the FIGURE, a portion of a frame buffer 10 is illustrated. These buffers are frequently used in connection with raster scanned video displays for storing a frame of data. The data is scanned and the data stored in the buffer read to provide a video signal for, for example, a cathode ray tube. Typically, a plurality of bits are stored for each pixel in the display. Again, by way of example, for each of the pixels in the display N-bits of color data may be stored and this color data may represent RGB or a pointer in a color lookup table.

Referring to the frame buffer 10, the data storage associated with a single pixel is shown within bracket 12. With the present invention, this data includes color data **12*b* and color mode data 12*a*. In the presently preferred embodiment, for each pixel, 24 bits of color data is stored along with two bits of color mode data. The two bits of color mode data are coupled through the bus 14, through lines 16 to a bank select table 25. The 24 bits of color data are coupled first through the bus 14 then onto bus 18 to a crossbar switch 20**.

The crossbar switch 20 provides routing of the 24 lines in bus 18 to selected ones of the lines in the buses 34, 38 and 42 at the output of the switch 20. Each line in bus 18 can be connected to selected lines of buses 34, 38, and 42. By way of example, examining the crossbar switch 20, the bus 18 is routed as shown by lines 30 in the switch. Two of the lines **30*a* and 30*b* of bus 18 are shown. Two lines of output bus 34 are shown as lines 34*a* and 34*b*; line 34*a* is connected to line 30*b* by the connection 46 and line 34*b* is connected to line 30*a* by connection 44. In a similar manner, two lines of bus 38 are shown as lines 38*a* and 38*b*; line 38*a* is shown connected to line 30*b*. Line 38*b*, however, is not connected to line 30*a*, (note there is no connection at 48). Again, two lines of bus 42 are shown as lines 42*a* and 42*b*; line 42*a* is not connected to line 30*b* while line 42*b* is connected to line 30*a*. In effect, the crossbar switch provides routing and connections between the 24 lines of bus 18 with selected ones of the 24 lines in the buses 34, 38 and 42**. In the presently preferred embodiment the number of output lines is equal to the number of input lines times a positive integer.

The connections such as 44 and 46 are programmable in the presently preferred embodiment, that is, they are selectively made by the user although such programming cannot be done "on the fly". The programming determines which colors will be obtainable from the color data bits **12*b***.

An ordinary 3 to 1 multiplexer 22 selects between the buses 34, 38 and 42 and provides a 24-bit output signal on bus 54. The digital output signals from the multiplexer 22 may directly represent RGB, that is, they can be convered to an analog signal and provide the RGB data used for directly driving a monitor. Alternatively, the digital output signal may provide an index to a lookup table which provides other signals for the display or the signals on bus 54 may in some other way provide color.

The two bits of mode data 12*a* may be directly coupled to the multiplexer 22 and used to select between buses 34, 38 and 42 (with two bits, a multiplexer can select between four buses). However, in the currently preferred embodiment, the color mode signals do not directly select among the sets of signals at the output of the multiplexer 22, but rather are used to indirectly select among these sets of signals. In the presently preferred embodiment, the two bits on line 16 are coupled to a bank select table 25 to address the table. The table's output provides a two bit code that controls the bank select register 28. The codes at the output of the table 25 are shown with 00 being interpreted as no change (the multiplexer 22 continues to select the previously selected bus); 01, switch to bus 34; 10, switch to bus 28; and 11, switch to bus 42. The two bits from the register 28 are applied to the multiplexer 22 over lines 56 and thus are used to control the selection among the three buses.

Note that with the apparatus shown in the FIGURE, the N-bits of data 12*b* (e.g., 24 bits) are routed to provide M-bits (e.g., 72 bits) of data at the output of the crossbar switch 20. The 72 bits are grouped into three sets of 24 bits with each group being capable of providing a different 24 bit color signal. Importantly, the crossbar switch has only $N \times M$ (e.g., $24 \times 72$) possible connections. Thus, the crossbar switch along with the multiplexer 24 provides what would otherwise require (if a PROM were used without the multiplexer) $2^{N+2}.24$ memory cells. Therefore, there is a substantial savings in hardware when using the apparatus of the FIGURE as opposed to using a PROM to obtain the same result.

I claim:

1. In a raster scanned, video display apparatus having a buffer which stores N-bits representing color for each of at least a plurality of pixels, an improvement for permitting said N-bits to represent a plurality of different colors comprising:

storage means for each of at least certain of said pixels in said display for storing signals representing a color mode, said storage means being associated with said buffer;

routing means for routing said N-bits to provide a plurality of sets of signals, said routing means being coupled to said buffer;

multiplexing means coupled to receive said plurality of sets of signals from said routing means and controllable for selecting one of said sets of signals from among said sets of signals and control means coupled to receive and being responsive to said color mode signals from said storage means for controlling said multiplexing means;

whereby said selection among said sets of signals provides different colors.

2. The improvement defined by claim 1 wherein said routing means is a programmable means.

3. The improvement defined by claim 1 wherein said routing means comprises a crossbar switch.

4. The improvement defined by claim 1 wherein each of said sets of signals comprises N-bits.

5. The improvement defined by claim 4 wherein said sets of signals are digital signals which provide RGB information.

6. In a raster scanned, video disply apparatus having a buffer which stores N-bits representing color for each pixel in said display, an improvement for permitting said N-bits to represent a plurality of different colors comprising:

storage means for each of said pixels for storing signals representing a color mode, said storage means being incorporated into said buffer;

routing means for providing a plurality of sets of signals each of N-bits from said N-bits, said routing means being coupled to receive said buffer;

multiplexing means coupled to receive said plurality of sets of signals from said routing means and controllable for selecting one of said sets of signals; and said control means being coupled to receive and being responsive to said color mode signal from said buffer to control said multiplexing means;

whereby said selection among said sets of signals provide different colors.

7. The improvement defined by claim 6 wherein said routing means is a programmable means.

8. The improvement defined by claim 6 wherein said routing means comprises a crossbar switch.

9. The improvement defined by claim 8 wherein said sets of signals from said multiplexing means are digital signals representing RGB information.

10. In a raster scanned video display apparatus which includes a buffer for storing N-bits representing color for each pixel in said display, an improvement for permitting said N-bits to represent a plurality of different colors comprising:

storage means included within said buffer for each of said pixels for storing signals representing a color mode;

a programmable crossbar switch coupled to said storage means for receiving said N-bits and for providing a plurality of sets of signals;

multiplexing means coupled to said crossbar switch for receiving said plurality of set of signals from said crossbar switch and being controllable to select one of said sets of signals;

control means coupled to receive and being responsive to said color mode signals for controlling said multiplexing means;

whereby said selection among said sets of signals provides different colors.

* * * * *